US008293962B2

(12) United States Patent
Hommeltoft et al.

(10) Patent No.: US 8,293,962 B2
(45) Date of Patent: Oct. 23, 2012

(54) PROCESS FOR PRODUCING A GASOLINE BLENDING COMPONENT AND A MIDDLE DISTILLATE BY ADJUSTING A LEVEL OF A HALIDE CONTAINING ADDITIVE DURING ALKYLATION

(75) Inventors: Sven Ivar Hommeltoft, Pleasant Hill, CA (US); Stephen Joseph Miller, San Francisco, CA (US); Ajit Ramchandra Pradhan, Walnut Creek, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 13/443,032

(22) Filed: Apr. 10, 2012

(65) Prior Publication Data

US 2012/0226086 A1 Sep. 6, 2012

Related U.S. Application Data

(62) Division of application No. 13/035,265, filed on Feb. 25, 2011, which is a division of application No. 12/184,109, filed on Jul. 31, 2008, now Pat. No. 7,919,663.

(51) Int. Cl.
*C07C 2/60* (2006.01)
*C07C 2/62* (2006.01)

(52) U.S. Cl. ..... 585/724; 585/725; 585/727; 585/728

(58) Field of Classification Search ..... 585/724, 585/725, 727, 728
See application file for complete search history.

(56) References Cited

U.S. PATENT DOCUMENTS

| | | | |
|---|---|---|---|
| 674,962 | A | 5/1901 | Cuming |
| 4,501,653 | A | 2/1985 | Hamner |
| 5,877,383 | A | 3/1999 | Hommeltoft et al. |
| 5,994,601 | A | 11/1999 | Nierlich et al. |
| 6,605,206 | B1 | 8/2003 | Johnson et al. |
| 6,768,035 | B2 | 7/2004 | O'Rear et al. |
| 6,841,711 | B2 | 1/2005 | Krug et al. |
| 6,890,423 | B2 | 5/2005 | O'Rear |
| 7,320,748 | B2 | 1/2008 | Hemighaus et al. |
| 2004/0267070 | A1 | 12/2004 | Johnson et al. |
| 2005/0245778 | A1 | 11/2005 | Johnson et al. |
| 2006/0121209 | A1 | 6/2006 | Baselmans et al. |
| 2006/0237344 | A1 | 10/2006 | Abernathy et al. |
| 2007/0142684 | A1 | 6/2007 | Elomari et al. |
| 2007/0142690 | A1 | 6/2007 | Elomari |
| 2007/0225538 | A1 | 9/2007 | Elomari |

FOREIGN PATENT DOCUMENTS

| | | |
|---|---|---|
| EP | 0839781 | 5/1998 |
| WO | WO2006083699 | 8/2006 |

OTHER PUBLICATIONS

Sven War Hommeltoft, "Flexibility of a New Fixed-Bed Alkylation Technology Applying a Supported Liquid Superacid in a Movable Catalyst Zone", Symposium on New Chemistry with Solid-Acid Catalysts in the Alkylation of Isobutane with Olefins, Aug. 25-29, 1996, pp. 700-705.

U.S. Appl. No. 12/003,576, Ionic Liquid Catalyst Alkylation Using A Loop Reactor (Isoparaffin Recirculation), Huping Luo, et al., Filed Dec. 28, 2007, 15 pages.

U.S. Appl. No. 12/003,580 Ionic Liquid Catalyst Alkylation Using Split Reactants Streams, Huping Luo, et al., Filed Dec. 28, 2007, 16 pages.

Qualification of Sasol Fully Synthetic Jet Fuel as Commercial Aviation Turbine Fuel, TIACA Executive Conference, Grand Hyatt Beijing, China, Apr. 10-11, 2008, Petrus N.J. Roets Sasol Technology Fuels Research.

C.A. Moses, et al., Qualification of Sasol Semi-Synthetic Jet A-1 As Commercial Jet Fuel, Nov. 1997, Piet Roets Sasol Oil R&D, Sasolburg, Republic of South Africa.

Propylene Tetramer—WCT, Application: Propylene Tetramer is a highly branched, mono-olefin used in the manufacturing several compounds, such as branched alkyl benzenes, phenates, sulfonates, and the other alkylates, Mar. 11, 2008.

*Primary Examiner* — Thuan D Dang
(74) *Attorney, Agent, or Firm* — Susan M. Abernathy

(57) ABSTRACT

A process for producing a gasoline blending component and a middle distillate, comprising adjusting a level of a halide containing additive provided to an ionic liquid alkylation reactor to shift selectivity towards heavier products, and recovering a low volatility gasoline blending component and the middle distillate.

12 Claims, 2 Drawing Sheets

PROCESS FOR PRODUCING A GASOLINE BLENDING COMPONENT AND A MIDDLE DISTILLATE BY ADJUSTING A LEVEL OF A HALIDE CONTAINING ADDITIVE DURING ALKYLATION

This application is a division of prior application Ser. No. 13/035,265, filed Feb. 25, 2011, and published as US 2011-0147269 A1, which was a prior division of prior application Ser. No. 12/184,109, filed Jul. 31, 2008, now U.S. Pat. No. 7,919,663, both herein incorporated in their entireties.

This application also claims priority benefit to four previously-filed patent applications filed on Jul. 31, 2008, titled "Process for Producing a Middle Distillate" (U.S. Pat. No. 7,923,593), "Process for Producing a Jet Fuel (U.S. Pat. No. 7,919,664), "Composition of Middle Distillate" (U.S. Pat. No. 7,955,495), and "Process for Producing Middle Distillate by Alkylating C5+ Isoparaffin and C5+ Olefin" U.S. Pat. No. 7,923,594), herein incorporated in their entireties.

FIELD OF THE INVENTION

This invention is directed to a process for producing a low volatility gasoline blending component and a middle distillate using an ionic liquid.

DETAILED DESCRIPTION OF THE INVENTION

Figure 1:
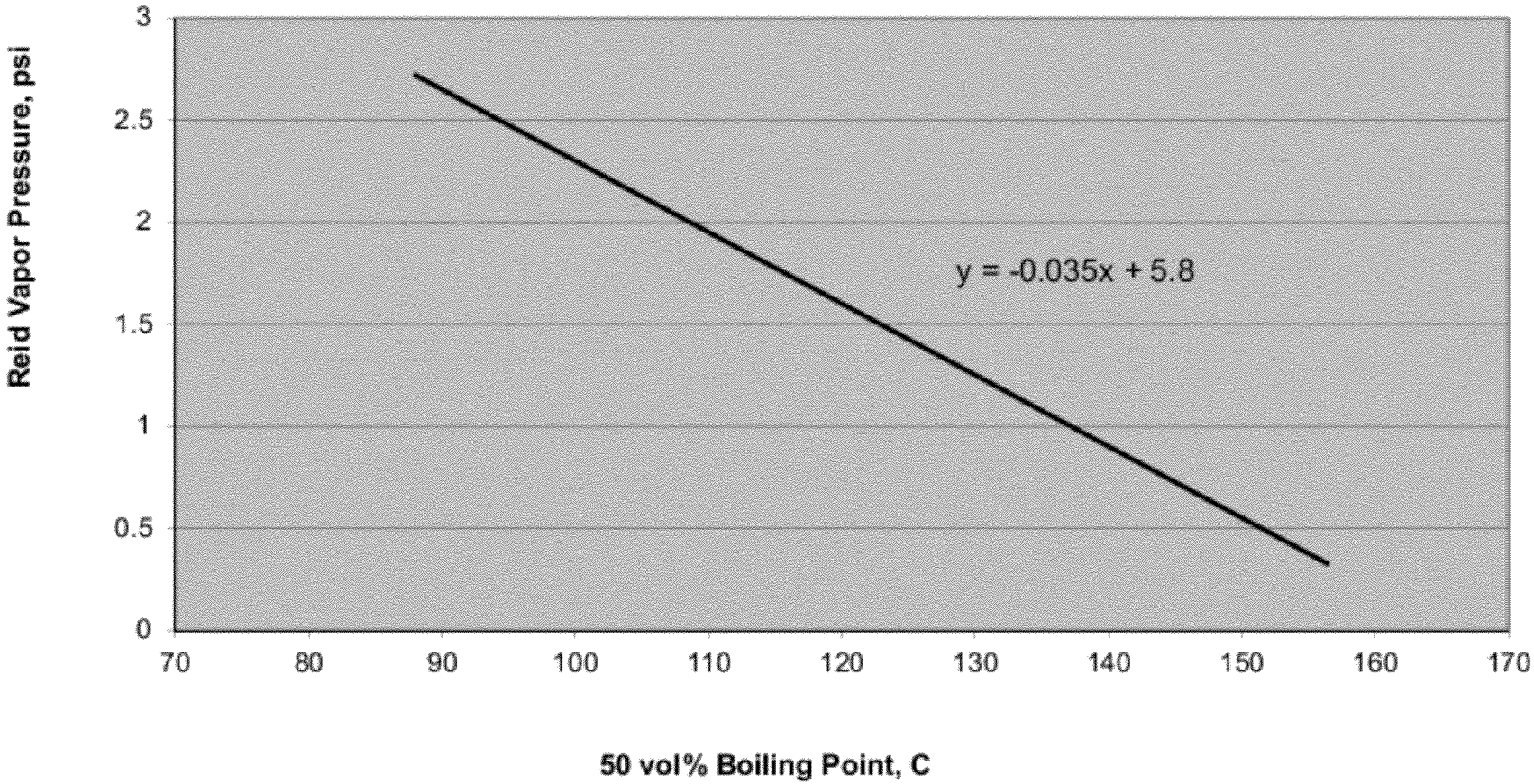
FIG. 1 illustrates the line defined by the equation: RVP=−0.035×(50 vol % boiling point, ° C.)+5.8.

Definitions:

The term "comprising" means including the elements or steps that are identified following that term, but any such elements or steps are not exhaustive, and an embodiment may include other elements or steps.

A "middle distillate" is a hydrocarbon product having a boiling range between 250° F. to 1100° F. (121° C. to 593° C.). The term "middle distillate" includes the diesel, heating oil, jet fuel, and kerosene boiling range fractions. It may also include a portion of naphtha or light oil. A "naphtha" is a lighter hydrocarbon product having a boiling range between 100° F. to 400° F. (38° C. to 204° C.). A "light oil" is a heavier hydrocarbon product having a boiling range that starts near 600° F. (316° C.) or higher. A "jet fuel" is a hydrocarbon product having a boiling range in the jet fuel boiling range. The term "jet fuel boiling range" refers to hydrocarbons having a boiling range between 280° F. and 572° F. (138° C. and 300° C.). The term "diesel fuel boiling range" refers to hydrocarbons having a boiling range between 250° F. and 1000° F. (121° C. and 538° C.). The term "light oil boiling range" refers to hydrocarbons having a boiling range between 600° F. and 1100° F. (316° C. and 593° C.). The "boiling range" is the 10 vol % boiling point to the final boiling point (99.5 vol %), inclusive of the end points, as measured by ASTM D 2887-06a.

A "middle distillate blending component" is a middle distillate, suitable for blending into a hydrocarbon product meeting desired specifications.

A "gasoline blending component" may be either a gasoline or a naphtha hydrocarbon product suitable for blending into a gasoline. "Gasoline" is a liquid hydrocarbon used as a fuel in internal combustion engines.

A "low volatility gasoline blending component" is a naphtha hydrocarbon product having a boiling range between 100° F. to 380° F. (38° C. to 193° C.) and a Reid Vapor Pressure of 2.5 psi (17.2 kPa) or less. In one embodiment the Reid Vapor Pressure is less than an amount defined by the equation RVP=−0.035×(50 vol % boiling point, ° C.)+5.8, in psi.

"Alkyl" means a linear saturated monovalent hydrocarbon radical of one to six carbon atoms or a branched saturated monovalent hydrocarbon radical of three to eight carbon atoms. In one embodiment, the alkyl groups are methyl. Examples of alkyl groups include, but are not limited to, groups such as methyl, ethyl, n-propyl, isopropyl, n-butyl, isobutyl, sec-butyl, t-butyl, n-pentyl, and the like.

"Unsupported" means that the catalyst or the halide containing additive is not on a fixed or moveable bed of solid contact material, such as non-basic refractory material, e.g., silica.

Test Method Descriptions:

API Gravity is measured by ASTM D 287-92 (Reapproved 2006) or ASTM D 1298-99 (Reapproved 2005).

Density is measured by ASTM D 1298-99 (Reapproved 2005) or ASTM D 4052-96 (Reapproved 2002). Density is reported in g/ml, at the reference temperature in ° F.

The test methods used for boiling range distributions of the compositions in this disclosure are ASTM D 2887-06a and ASTM D 6352-04. The test method is referred to herein as "SimDist". The boiling range distribution determination by distillation is simulated by the use of gas chromatography. The boiling range distributions obtained by this test method are essentially equivalent to those obtained by true boiling point (TBP) distillation (see ASTM Test Method D 2892), but are not equivalent to results from low efficiency distillations such as those obtained with ASTM Test Methods D 86 or D 1160.

Reid Vapor Pressure (RVP) is measured directly by ASTM D 5191-07. Alternatively, Reid Vapor Pressure (RVP) is calculated from the boiling range data obtained by gas chromatography. The calculation is described in the ASTM special publication by de Bruine, W., and Ellison, R. J., "Calculation of ASTM Method D 86-67 Distillation and Reid Vapor Pressure of a Gasoline from the Gas-Liquid Chromatographic True Boiling Point, STP35519S, January 1975. To convert Reid vapor pressure expressed in psi, multiply the result by 6.895 to obtain the Reid vapor pressure in kPa.

Total weight percents of carbon, hydrogen, and nitrogen (C/H/N) is determined with a Carlo Erba 1106 Analyzer by ASTM D 5291-02 (Reapproved 2007).

Low level nitrogen is separately determined by oxidative combustion and chemiluminescence by D 4629-02 (Reapproved 2007). Sulfur is measured by ultraviolet fluorescence by ASTM 5453-08a.

Flash Point is measured in a small scale closed-cup apparatus by D 3828-07a. Smoke Point is measured by D 1322-97 (Reapproved 2002)e1. Cloud Point is measured by ASTM D 5773-07. Freeze Point is measured by ASTM D 5972-05. Kinematic viscosity at −20° C. is measured by ASTM D 445-06. The Net Heat of Combustion is estimated by ASTM D 3338-05, and reported in both Btu/lb and MJ/kg.

Different methods are used for calculating octane numbers of fuels or fuel blend components. The Motor-method octane number (MON) is determined using ASTM D 2700-07b. The Research-method octane number (RON) is determined using ASTM D 2699-07a. MON and RON both employ the standard Cooperative Fuel Research (CFR) knock-test engine. Additionally, the Research-method octane number may be calculated [RON (GC)] from gas chromatography boiling range distribution data. The RON (GC) calculation is described in the publication, Anderson, P. C., Sharkey, J. M., and Walsh, R. P., "Journal Institute of Petroleum", 58 (560), 83 (1972).

The Calculated Cetane Index is calculated according to ASTM D 4737-04.

The vol % of the different carbon numbers (C10+, C11+, C17+, C27+, C43+, and C55+) in the hydrocarbons is determined from the ASTM D 2887 boiling points (SimDist), using the following chart of the boiling points of paraffins with different carbon numbers. In the context of this disclosure the vol % of C10+, for example, is the vol % of the hydrocarbon product that boils above C9 paraffin, or above 304° F. (151° C.). The vol % of C11+, for example, is the vol % of the hydrocarbon product that boils above C10 paraffin, or above 345° F. (174° C.). The volume of C55+, for example, is the vol % of the hydrocarbon product that boils above C54 paraffin, or above 1098° F. (592° C.).

| Carbon Number | Boiling Point, ° F. | Boiling Point, ° C. |
|---|---|---|
| C9 | 304 | 151 |
| C10 | 345 | 174 |
| C11 | 385 | 196 |
| C16 | 549 | 287 |
| C17 | 576 | 302 |
| C26 | 774 | 412 |
| C27 | 791 | 422 |
| C42 | 993 | 534 |
| C43 | 1003 | 539 |
| C54 | 1098 | 592 |
| C55 | 1105 | 596 |

The extent of branching and branching position can be determined by NMR Branching Analysis.

NMR Branching Analysis

The NMR branching properties of the samples were obtained on a 500 MHz Bruker AVANCE spectrometer operating at 500.116 MHz and using 10% solutions in $CDCl_3$. All spectra were obtained under quantitative conditions using 90 degree pulse (5.6 μs), recycle delay of 4 second and 128 scans to ensure good signal-to-noise ratios. TMS was used as an internal reference. The hydrogen atom types were defined according to the following chemical shift regions:

0.5-1.0 ppm paraffinic $CH_3$ methyl hydrogen 1.0-1.4 ppm paraffinic $CH_2$ methylene hydrogen 1.4-2.1 ppm paraffinic CH methine hydrogen 2.1-4.0 ppm hydrogen at α-position to aromatic ring or olefinic carbon 4.0-6.0 ppm hydrogen on olefinic carbon atoms 6.0-9.0 ppm hydrogen on aromatic rings The NMR Branching Index is calculated as the ratio in percent of non-benzylic methyl hydrogen in the range of 0.5 to 1.0 ppm chemical shift, to the total non-benzylic aliphatic hydrogen in the range of 0.5 to 2.1 ppm chemical shift.

The $CH_3$ to $CH_2$ hydrogen ratio is defined as the ratio in percent of non-benzylic methyl hydrogen in the range of 0.5 to 1.0 ppm chemical shift, to non-benzylic methylene hydrogen in the range 1.0 to 1.4 ppm chemical shift.

The percent aromatic proton is defined as the percent aromatic hydrogen in the range 6.0 to 9.0 ppm chemical shift among all the protons in the range 0.5 to 9.0 ppm chemical shift.

Processes for Producing Middle Distillate

In a first embodiment, there is provided a process for producing a middle distillate comprising reacting a refinery stream containing isobutane with a process stream containing butene under alkylation conditions, wherein the isobutane and butene are alkylated to produce an alkylate product in the presence of a chloroaluminate ionic liquid catalyst. The ionic liquid catalyst can comprise an alkyl substituted pyridinium chloroaluminate or an alkyl substituted imidazolium chloroaluminate of the general formulas A and B, respectively.

A

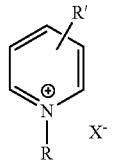

B

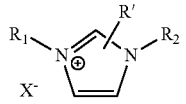

In the formulas A and B, R is H, methyl, ethyl, propyl, butyl, pentyl or hexyl group, R'=H, methyl, ethyl, propyl, butyl, pentyl or hexyl group, X is a chloroaluminate, and $R_1$ and $R_2$ are H, methyl, ethyl, propyl, butyl, pentyl or hexyl group. The ionic liquid catalyst may also comprise a derivative of either of the structures A or B in which one or more of the hydrogens attached directly to carbon in the ring has been replaced by an alkyl group. In the formulas A and B: R, R', $R_1$ and $R_2$ may or may not be the same. Alternatively the ionic liquid catalyst is a chloroaluminate ionic liquid having the general formula $RR'R''NH^+Al_2Cl_7^-$, wherein RR' and R" are alkyl groups containing 1 to 12 carbons. In this embodiment the method also comprises separating out the middle distillate from the alkylate product, wherein the separated middle distillate fraction is from 20 wt % or higher of the total alkylate product.

In a second embodiment, there is provided a process for producing a middle distillate or middle distillate blending component, comprising passing a feed to an ionic liquid alkylation zone, at alkylation conditions, and recovering an effluent comprising an alkylated product with defined carbon number distribution. In this embodiment, the feed comprises an olefin, an isoparaffin, and less than 5 wt % oligomerized olefin. The ionic liquid alkylation zone comprises an acidic haloaluminate ionic liquid. The alkylated product has greater than 30 vol % C10+ and less than 1 vol % C55+. In some embodiments the alkylated product has greater than 30 vol % C11+, for example greater than 40 vol % or greater than 50 vol % C11+. The olefin can have from 2 to 7 carbon atoms, or five carbons or less. In some embodiments there can be no oligomerized olefin in the feed. Separating can be done by any number of processes well known in the art, and in one embodiment may be distillation, such as vacuum or atmospheric distillation.

In a third embodiment, there is provided a process for producing a middle distillate or middle distillate blending component, comprising the steps of selecting a feed, mixing the feed with an isoparaffin to make a mixed feed, alkylating the mixed feed in an ionic liquid alkylation zone, and separating the middle distillate or the middle distillate blending component from the alkylated product. The feed used is one produced in a FC cracker comprising olefins. The middle distillate or the middle distillate blending component has greater than 30 vol % C10+, less than 1 vol % C55+, and a cloud point less than −50° C. In some embodiments the alkylated product has greater than 30 vol % C11+, for example greater than 40 vol % or greater than 50 vol % C11+.

The alkylation conditions are selected to provide the desired product yields and quality. The alkylation reaction is generally carried out in a liquid hydrocarbon phase, in a batch system, a semi-batch system, or a continuous system. Catalyst volume in the alkylation reactor is in the range of 1 vol % to 80 vol %, for example from 2 vol % to 70 vol %, from 3 vol % to 50 vol %, or from 5 vol % to 25 vol %. In some embodiments, vigorous mixing can be used to provide good contact between the reactants and the catalyst. The alkylation reaction temperature can be in the range from −40° C. to 150° C., such as −20° C. to 100° C., or −15° C. to 50° C. The pressure can be in the range from atmospheric pressure to 8000 kPa. In one embodiment the pressure is kept sufficient to keep the reactants in the liquid phase. The residence time of reactants in the reactor can be in the range of a second to 360 hours. Examples of residence times that can be used include 0.5 min to 120 min, 1 min to 120 min, 1 min to 60 min, and 2 min to 30 min.

In one embodiment, the separated middle distillate fraction is not the entire fraction. It can be in a range from 20 to 80 wt %, 29 to 80 wt %, 20 to 50 wt %, 29 to 50 wt %, 20 to 40 wt %, or 29 to 40 wt % of the total alkylate product.

In one embodiment, the isobutane stream is from a refinery, from a Fischer-Tropsch process, or is a mixture thereof. Substantial quantities of isobutane and normal butane are produced in refinery hydroconversion processes, for example hydrocracking and catalytic reforming. The isobutane stream may be fractionated from the products of the refinery hydroconversion processes, or it may be obtained at least in part by isomerization of normal butane.

In one embodiment, as described in U.S. Pat. No. 6,768,035 and U.S. Pat. No. 6,743,962, the isobutane stream is obtained from a Fischer-Tropsch process by subjecting a Fischer-Tropsch derived hydrocarbon fraction to hydrotreating, hydrocracking, hydrodewaxing, or combinations thereof; and recovering a fraction containing at least about 30 wt % isobutane.

In one embodiment, the process stream containing butene is from a refinery, from a Fischer-Tropsch process, or is a mixture thereof. In another embodiment the process stream containing butene is at least partially a separated fraction from crude oil. The process stream containing butene can be obtained from the cracking of long chain hydrocarbons. Cracking may be done by any known process, including steam cracking, thermal cracking, or catalytic cracking of long chain hydrocarbons. In one embodiment the process stream containing butene is from a FC cracker.

In another embodiment the process stream containing butene is from a Fischer-Tropsch process. The process stream may comprise a Fischer-Tropsch tail gas or a separated stream from tail gas. Some Fischer-Tropsch processes, such as those taught in EP0216972A1, are known to produce predominantly C2-C6 olefins.

In one embodiment the amount of the butene fraction in the process stream may be increased by dimerizing the ethylene in a Fischer-Tropsch or petroleum derived hydrocarbon. Processes for doing this are described, for example, in U.S. Pat. No. 5,994,601.

In another embodiment, the process stream containing butene is made by treating a hydrocarbon stream comprising C3-C4 olefins and alkanol with a dehydration/isomerization catalyst which converts the alkanols to olefins and isomerizes the C4 olefin. Examples of processes to do this are taught in U.S. Pat. No. 6,768,035 and U.S. Pat. No. 6,743,962.

The molar ratio of isoparaffin to olefin during the processes of this invention can vary over a broad range. Generally the molar ratio is in the range of from 0.5:1 to 100:1. For example, in different embodiments the molar ratio of isoparaffin to olefin is from 1:1 to 50:1, 1.1:1 to 10:1, or 1.1:1 to 20:1. Lower isoparaffin to olefin molar ratios will tend to produce a higher yield of higher molecular weight alkylate products.

In one embodiment, the middle distillate or the middle distillate blending component that is separated out in the process is comprised of a light fraction with boiling points in the jet fuel boiling range. Additionally a heavy fraction with boiling points above the jet fuel boiling range may also be separated. Under some conditions the light fraction with boiling points in the jet fuel boiling range meets the boiling point, flash point, smoke point, heat of combustion, and freeze point requirements for Jet A-1 fuel.

In one embodiment, the light fraction with boiling points in the jet fuel boiling range has a NMR branching index greater than 60, greater than 65, greater than 70, greater than 72, or even greater than 73. The NMR branching index is generally less than 90.

The level and type of branching in the middle distillate can be selected to give improved properties. The level of branching and CH3/CH2 hydrogen ratio can be controlled by adjusting the level of the halide containing additive. In some embodiments, a high branching index raises the flash point of the middle distillate. In other embodiments, a high CH3/CH2 hydrogen ratio lowers the freeze point of the middle distillate.

In one embodiment, the separating step in the process additionally produces a low volatility gasoline blending component. Under certain conditions the low volatility gasoline blending component has a Reid Vapor Pressure less than 2.2 psi (15.2 kPa) or less than the amount defined by the equation: RVP=−0.035×(50 vol % boiling point, ° C.)+5.8, in psi. The chart of this equation is shown in FIG. 1. To convert psi to kPa, multiply the result by 6.895.

Ionic liquid alkylation produces an alkylate product having a low level of olefins, even without any further optional hydroprocessing. In one embodiment, the alkylate product, or separated fraction thereof, has less than 5 wt % olefins. The level of olefins may be even less, such as less than 3 wt %, less than 2 wt % olefins, less than 1 wt % olefins, or essentially none. The wt % olefins can be measured by proton NMR by the method described in US Patent Publication No. US20060237344, fully incorporated herein.

Ionic liquid alkylation produces a high yield of alkylate product based on the amount of olefin in the feed to the ionic liquid alkylation reactor. For example, in one embodiment the yield of alkylated product exceeds the amount of olefin supplied to the ionic liquid reactor by at least 30 wt %. In other embodiments the yield of alkylate can be at least two times on a weight basis of the amount of olefin supplied to the ionic liquid reactor. In different embodiments, the amount of olefin supplied to the ionic liquid reactor can be the amount of olefin in the process stream containing butene, the amount of olefin in the feed supplied to the ionic liquid alkylation zone, the amount of olefin in the hydrocarbon steam reacted by the ionic liquid catalyst, the amount of olefin in the feed produced in a FC reactor, or the amount of olefin in a mixed feed supplied to the ionic liquid alkylation zone.

Ionic Liquid Catalyst

The ionic liquid catalyst is composed of at least two components which form a complex. To be effective at alkylation the ionic liquid catalyst is acidic. The acidic ionic liquid catalyst comprises a first component and a second component. The first component of the catalyst will typically comprise a Lewis Acidic compound selected from components such as Lewis Acidic compounds of Group 13 metals, including aluminum halides, alkyl aluminum halide, gallium halide, and alkyl gallium halide (see International Union of Pure and Applied Chemistry (IUPAC), version3, October 2005, for Group 13 metals of the periodic table). Other Lewis Acidic compounds besides those of Group 13 metals may also be used. In one embodiment the first component is aluminum halide or alkyl aluminum halide. For example, aluminum trichloride may be used as the first component for preparing the ionic liquid catalyst.

The second component making up the ionic liquid catalyst is an organic salt or mixture of salts. These salts may be characterized by the general formula Q+A−, wherein Q+ is an ammonium, phosphonium, boronium, iodonium, or sulfonium cation and A− is a negatively charged ion such as Cl—, Br—, ClO4-, NO3-, BF4-, BCl4-, PF6-, SbF6-, AlCl4-, ArF6-, TaF6-, CuCl2-, FeCl3-, SO3CF3-, SO3C7-, and 3-sulfurtrioxyphenyl. In one embodiment the second component is selected from those having quaternary ammonium halides containing one or more alkyl moieties having from about 1 to about 9 carbon atoms, such as, for example, trimethylamine hydrochloride, methyltributylammonium, 1-butylpyridinium, or hydrocarbyl substituted imidazolium halides, such as for example, 1-ethyl-3-methyl-imidazolium chloride. In one embodiment the ionic liquid catalyst is a chloroaluminate ionic liquid having the general formula $RR'R''NH^{+}Al_2Cl_7^{-}$, wherein RR' and R" are alkyl groups containing 1 to 12 carbons. In one embodiment the ionic liquid catalyst is an acidic haloaluminate ionic liquid, such as an alkyl substituted pyridinium chloroaluminate or an alkyl substituted imidazolium chloroaluminate of the general formula A and B, as discussed previously.

The presence of the first component should give the ionic liquid a Lewis or Franklin acidic character. Generally, the greater the mole ratio of the first component to the second component, the greater the acidity of the ionic liquid mixture.

Halide Containing Additive

In one embodiment, a halide containing additive is present during the reacting. The halide containing additive can be selected, and present at a level, to provide increased yield of the middle distillate. In this embodiment, the reacting is performed with a halide containing additive in addition to the ionic liquid catalyst. The halide containing additive can boost the overall acidity and change the selectivity of the ionic liquid-based catalyst. Examples of halide containing additives are hydrogen halide, metal halide, and combinations thereof. In one embodiment, the halide containing additive may be a Bronsted acid. Examples of Bronsted acids are hydrochloric acid (HCl), hydrobromic acid (HBr), and trifluoromethanesulfonic acid. The use of halide containing additives with ionic liquid catalysts is disclosed in U.S. Published Patent Application Nos. 2003/0060359 and 2004/0077914. In one embodiment the halide containing additive is a fluorinated alkane sulphonic acid having the general formula:

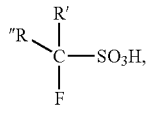

wherein R'=Cl, Br, I, H, an alkyl or perfluoro alkyl group, and R"=H, alkyl, aryl or a perfluoro alkoxy group.

Examples of metal halides that may be used are NaCl, LiCl, KCl, BeCl2, CaCl2, BaCl2, SrCl2, MgCl2, PbCl2, CuCl, ZrCl4 and AgCl, as described by Roebuck and Evering (Ind. Eng. Chem. Prod. Res. Develop., Vol. 9, 77, 1970). In one embodiment, the halide containing additive contains one or more IVB metal compounds, such as ZrCl4, ZrBr4, TiCl4, TiCl3, TiBr4, TiBr3, HfCl4, or HfBr4, as described by Hirschauer et al. in U.S. Pat. No. 6,028,024.

In one embodiment, the halide containing additive is present during the reacting step at a level that provides increased yield of the middle distillate. Adjusting the level of the halide containing additive level can change the selectivity of the alkylation reaction. For example, when the level of the halide containing additive, e.g., hydrochloric acid, is adjusted lower, the selectivity of the alkylation reaction shifts towards producing heavier products. In one embodiment, the adjustment in the level of the halide containing additive to produce heavier products does not impair the concurrent production of low volatility gasoline blending component. The effects of increasing the molar ratio of olefin to HCl in the feed to the ionic liquid reactor (adjusting the level of the hydrochloric acid lower) on the yield of C10+ products in the alkylate produced is demonstrated in FIG. 2.

In one embodiment the halide containing additive is unsupported.

In one embodiment the separated, or recovered, middle distillate fraction has greater than 30 vol % C10+. The middle distillate can have even higher levels of C10+, such as greater than 35 vol %, greater than 40 or 50 vol %, or even greater than 90 vol %. The levels of very heavy C43+ or C55+ are limited. In one embodiment the level of C55+ in the separated, or recovered, middle distillate fraction has less than 1 vol % C55+, such as less than 0.5 or 0 vol % C55+. In one embodiment the level of C43+ in the separated, or recovered, middle distillate fraction has less than 5 vol % C43+, such as less than 1 vol %, less than 0.5 vol %, or 0 vol %.

In one embodiment the separated middle distillate or middle distillate blending component meets the boiling point, flash point, smoke point, heat of combustion, and freeze point requirements for Jet A-1 fuel.

The wt % oligomerized olefin in the feed is low, generally less than 10 wt % or 5 wt %. The wt % oligomerized olefin in the feed can be less than 4 wt %, 3 wt %, 2 wt %, or 1 wt %. In one embodiment there is no oligomerized olefin in the feed.

Processes for Producing a Low Volatility Gasoline Blending Component and a Middle Distillate The processes described above can also be used for producing both a gasoline blending component and a middle distillate. In a first and second embodiment of a process to produce a gasoline blending component and a middle distillate, the process comprises the steps of reacting and separating.

In the first embodiment, the reacting step comprises: reacting an isobutane stream with a process stream containing butene under alkylation conditions wherein the isobutane and butene are alkylated to produce an alkylate product in the presence of a chloroaluminate ionic liquid catalyst. The chloroaluminate ionic liquid catalyst comprises an alkyl substituted pyridinium chloroaluminate or an alkyl substituted imidazolium chloroaluminate of the general formulas A and B, as described previously.

In the second embodiment, the reacting step comprises: reacting a hydrocarbon stream comprising at least one olefin having from 2 to 6 carbon atoms and at least one paraffin having from 4 to 6 carbon atoms, with an ionic liquid catalyst and a halide containing additive. The reacting is done such that the at least one olefin and the at least one paraffin are alkylated to produce a broad boiling alkylate. The process produces a low volatility gasoline blending component.

In the first embodiment, the separating step separates out the middle distillate from the alkylate product, wherein the separated middle distillate fraction is from 20 wt % or higher of the total alkylate product, and wherein the separated gasoline blending component has a RON of 91 or higher.

In the second embodiment, the separating step separates the broad boiling alkylate into at least the low volatility gasoline blending component and at least the fuel suitable for use as a jet fuel or jet fuel blending component. The fuel suitable for use as a jet fuel or jet fuel blending component has a boiling range between 280° F. to 572° F. (138° C. to 300° C.), a flash point greater than 40° C., and a cloud point less than −50° C.

In a third embodiment, there is provided a process for producing a gasoline blending component and a middle distillate, comprising the steps of adjusting a level of a halide containing additive in an alkylation reactor and recovering the gasoline blending component and the middle distillate from the alkylate product produced in the reactor. The alkylation reactor is an ionic liquid alkylation reactor. Adjusting the level of the halide containing additive provided to the ionic liquid alkylation reactor shifts the selectivity towards heavier products in the alkylate product.

The hydrocarbon stream feed to any of these processes can come from a crude oil, a refinery, a Fischer-Tropsch process; or it can be a blend thereof. In one embodiment, the hydrocarbon stream is a blend of two streams, one stream comprising at least one olefin and the second stream comprising at least one isoparaffin.

The process is not limited to any specific hydrocarbon stream and is generally applicable to the alkylation of C4-C6 isoparaffins with C2-C6 olefins from any source and in any combination. In one embodiment, the hydrocarbon stream comprises at least one olefin from a FC cracker. In another embodiment, the hydrocarbon stream comprises Fischer-Tropsch derived olefins.

In one embodiment the ionic liquid catalyst is unsupported.

In one embodiment the process makes a low volatility gasoline blending component having a Reid Vapor Pressure less than 2.2 (15.2 kPa), or even less than an amount defined by the equation: RVP=−0.035×(50 vol % boiling point, ° C.)+5.8, in psi. In another embodiment the separating step provides two or more low volatility gasoline blending components.

In one embodiment, the middle distillate produced by the process has a high flash point, generally greater than 40° C., but it can be greater than 45° C., greater than 50° C., greater than 55° C., or greater than 58° C.

In one embodiment, the middle distillate produced by the process has a low cloud point, generally less than −50° C. or −55° C., but it can be less than −58° C., less than −60° C., or less than −63° C. Additionally, the middle distillate can have a low freeze point, such as less than −50° C., less than −55° C., less than −58° C., less than −60° C., or less than −63° C.

In one embodiment, as described earlier, the middle distillate produced by the process can have a NMR branching index greater than 60.

Processes for Producing a Jet Fuel

Additionally, there are provided processes for producing a jet fuel. The processes use the same teachings as described earlier herein. The processes include the steps of performing an alkylation and recovering the jet fuel.

In the first embodiment, the process comprises reacting an isobutane stream with a process stream containing butene under alkylation conditions. The isobutane and butene are alkylated to produce an alkylate product in the presence of a chloroaluminate ionic liquid catalyst. The chloroaluminate ionic liquid catalyst comprises an alkyl substituted pyridinium chloroaluminate or an alkyl substituted imidazolium chlororaluminate of the general formulas A and B, respectively.

A

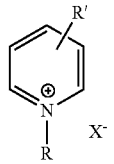

B

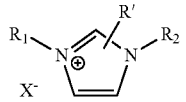

In the formulas A and B, R is H, methyl, ethyl, propyl, butyl, pentyl or hexyl group, R'=H, methyl, ethyl, propyl, butyl, pentyl or hexyl group, X is a chloroaluminate, and $R_1$ and $R_2$ are H, methyl, ethyl, propyl, butyl, pentyl or hexyl group. The ionic liquid catalyst may also comprise a derivative of either of the structures A or B in which one or more of the hydrogens attached directly to carbon in the ring has been replaced by an alkyl group. In the formulas A and B: R, R', $R_1$ and $R_2$ may or may not be the same. The jet fuel is separated out from the alkylate product. The jet fuel meets the boiling point, flash point, smoke point, heat of combustion, and freeze point requirements for Jet A-1 fuel.

In the second embodiment, the process for producing a jet fuel comprises performing an alkylation of an olefin and an isoparaffin with an unsupported catalyst system comprising an ionic liquid catalyst and a halide containing additive to make an alkylate product. The jet fuel is recovered from the alkylate product. The jet fuel meets the boiling point, flash point, smoke point, heat of combustion, and freeze point requirements for Jet A-1 fuel.

In the third embodiment, the process for producing a jet fuel comprises selecting a feed produced in a FC cracker comprising olefins. The feed is mixed with isoparaffin to make a mixed feed. The mixed feed is alkylated in an ionic liquid alkylation zone, at alkylation conditions, to form an alkylated product. The jet fuel is separated from the alkylated product. The jet fuel meets the boiling point, flash point, smoke point, heat of combustion, and freeze point requirements for Jet A-1 fuel.

In one embodiment the jet fuel is greater than 8 wt % of the total alkylate product. Examples include from 10 to 50 wt %, from 10 to 25 wt %, greater than 15 wt %, and from 15 to 50 wt %.

In some embodiments the jet fuel may have other desired properties, for example, a cetane index greater than 45, 50, or 55; a heat of combustion greater than 43, 45, or 47 MJ/Kg; a freeze point less than −47° C., −50° C., or −60° C.; a cloud point less than −47° C., −50° C., or −60° C.; a sulfur level of less than 10, 5, or 1 ppm (or essentially none); a flash point greater than 40° C., 50° C., or 55° C.; and a smoke point greater than 20, 30, or 35 mm.

A Composition of Middle Distillate

Additionally, there are provided compositions of middle distillate. The compositions use the same teachings as described earlier herein. The middle distillate comprises hydrocarbons having a boiling range between 150° C. and 350° C., a NMR branching index greater than 60, and a CH3/CH2 ratio greater than 2.6. In one embodiment the hydrocarbons have a sulfur content of less than 5 wppm, less than 3 wppm, less than 1 wppm, or essentially no sulfur. In one embodiment the hydrocarbons have a wt % aromatic protons less than 1.0, less than 0.5, less than 0.3, less than 0.1, less than 0.05, less than 0.01, or essentially no aromatic protons. Low aromatic protons helps improve smoke point, flash point, and net heat of combustion.

In one embodiment the boiling range of the hydrocarbons is between 175° C. and 300° C. In another embodiment the boiling range of the hydrocarbons is between 200° C. and 300° C.

As disclosed previously, where the middle distillate is an alkylate hydrocarbon product made by the processes disclosed herein, the level of olefin will be very low, generally less than 5 wt %, or less than 3 wt %, or less than 2 wt %, or less than 1 wt %, or essentially none.

In other embodiments the NMR branching index is greater than 65, greater than 70, or greater than 72. The hydrocarbons have a low freeze point, generally less than −20° C., but in some embodiments can be much lower, such as less than −45° C., less than −50° C., less than −55° C., less than −58° C., less than −60° C., or less than −63° C.

In some embodiments, the hydrocarbons have a high net heat of combustion. The net heat of combustion can be greater than 30 MJ/Kg, greater than 40 MJ/Kg, greater than 43 MJ/Kg, greater than 45 MJ/Kg, or greater than 47 MJ/Kg.

In some embodiments the hydrocarbons have a high smoke point, such as greater than 18 mm, greater than 30 mm, or greater than 40 mm. The smoke point is generally less than 80 mm.

In some embodiments the hydrocarbons have a high flash point, such as greater than 30° C., greater than 40° C., greater than 50° C., or greater than 55° C. The flash point is generally less than 90° C.

The hydrocarbons can meet the boiling point, flash point, smoke point, heat of combustion, and freeze point requirements for Jet A-1 fuel.

In one embodiment, the higher the CH3/CH2 hydrogen ratio the lower the freeze point of the hydrocarbons. In general the hydrocarbons have a CH3/CH2 ratio greater than 2.6. In other examples, they can have a ratio greater than 3.0 or greater than 3.5.

In one embodiment the middle distillate is made by alkylating an olefin and an isoparaffin with an unsupported ionic liquid catalyst and a halide containing additive. In some embodiments the ionic liquid catalyst does not contain any sulfur. The ionic liquid catalysts described previously are those that may be used.

In another embodiment, the middle distillate is made by alkylating an isoparaffin with an olefin under alkylating conditions over an unsupported ionic liquid catalyst and providing an amount of halide containing additive to the alkylating step to achieve the NMR branching index and the CH3/CH2 hydrogen ratio. In this embodiment, for example, the middle distillate can comprise hydrocarbons having a % aromatic protons less than 0.5, a sulfur content less than 5 wppm, or less than 3 wt % olefins. The amount of the halide containing additive provided during the alkylating step provides a molar ratio of olefin to HCl from 50:1 to 150:1, from 60:1 to 120:1, or from 70:1 to 120:1.

For the purposes of this specification and appended claims, unless otherwise indicated, all numbers expressing quantities, percentages or proportions, and other numerical values used in the specification and claims, are to be understood as being modified in all instances by the term "about." Furthermore, all ranges disclosed herein are inclusive of the endpoints and are independently combinable. Whenever a numerical range with a lower limit and an upper limit are disclosed, any number falling within the range is also specifically disclosed.

Any term, abbreviation or shorthand not defined is understood to have the ordinary meaning used by a person skilled in the art at the time the application is filed. The singular forms "a," "an," and "the," include plural references unless expressly and unequivocally limited to one instance.

All of the publications, patents and patent applications cited in this application are herein incorporated by reference in their entirety to the same extent as if the disclosure of each individual publication, patent application or patent was specifically and individually indicated to be incorporated by reference in its entirety.

This written description uses examples to disclose the invention, including the best mode, and also to enable any person skilled in the art to make and use the invention. Many modifications of the exemplary embodiments of the invention disclosed above will readily occur to those skilled in the art. Accordingly, the invention is to be construed as including all structure and methods that fall within the scope of the appended claims.

EXAMPLES

Example 1

Alkylate was prepared in a 100 ml laboratory continuously stirred (1600 RPM) reactor operating at 10° C. and 150 psig (1034 KPa). The alkylate was accumulated from several alkylation runs in this reactor setup. The feedstock for the alkylation was mixed C4 olefins (butene) from an FC cracker containing 40-50% olefins and the balance being isobutane and n-butane (feed flow @ 2 ml/min.), and refinery isobutane containing 80% or more of isobutane (feed flow @ 8 ml/min.). The molar ratio of isoparaffin to olefin was in the range of about 10:1. None of the feed to the alkylation reactor was oligomerized olefins. N-butylpyridinium chloroaluminate ($C_5H_5NC_4H_9Al_2Cl_7$) ionic liquid doped with hydrochloric acid was used as catalyst and added in a continuous stream to the alkylation reactor at a volumetric flow of 0.8 ml/min. The ionic liquid and the hydrochloric acid were unsupported. The level of hydrochloric acid was selected, and adjusted over time, to provide a good yield of middle distillate, without adversely effecting the quality of the lighter boiling alkylate product. The alkylate from the reactor effluent was separated from unconverted butanes by flash-distillation and the alkylate was separated from the ionic liquid by phase separation.

8,408 g of the accumulated alkylate effluent from the alkylation reactor was cut into 4 fractions by atmospheric distillation. The yields obtained and their properties are shown below in Table 1.

TABLE 1

| | Fraction 1 | Fraction 2 | Fraction 3 | Fraction 4 |
|---|---|---|---|---|
| Utility | Light Naphtha | Heavy Naphtha | Jet Fuel | Heavy Diesel/ Heating Oil |
| Yield, g | 4753.8 | 1186.8 | 1397 | 1054 |
| Yield, ml at 60° F. | 6840 | 1625 | 1817 | 1272 |
| Yield, wt % based on combined alkylate products | 56.6 | 14.1 | 16.6 | 12.5 |
| API Gravity | 72.1 | 62.1 | 52.5 | 39.3 |
| Density, 60° F. | 0.695 | 0.7305 | 0.769 | 0.8285 |
| SimDist, ° F. | | | | |
| 10 vol % | 132 | 248 | 353 | 520 |
| 20 vol % | 198 | 251 | 360 | 547 |
| 30 vol % | 201 | 253 | 368 | 570 |

TABLE 1-continued

| | Fraction 1 | Fraction 2 | Fraction 3 | Fraction 4 |
|---|---|---|---|---|
| 40 vol % | 202 | 271 | 376 | 593 |
| 50 vol % | 204 | 292 | 391 | 623 |
| 60 vol % | 221 | 294 | 406 | 655 |
| 70 vol % | 230 | 300 | 421 | 691 |
| 80 vol % | 234 | 327 | 448 | 736 |
| 90 vol % | 239 | 335 | 475 | 805 |
| FBP (99.5) | 264 | 368 | 525 | 995 |
| Composition, Vol % by GC | | | | |
| C10+ | | >20 | >95 | >99 |
| C11+ | | <5 | >90 | >95 |
| C17+ | 0 | 0 | 0 | >70 |
| C27+ | 0 | 0 | 0 | >10 |
| C43+ | 0 | 0 | 0 | <1 |
| C55+ | 0 | 0 | 0 | 0 |

Fraction 3 and Fraction 4 are middle distillates. After separating them from the total alkylate, they amounted to 29.1 wt % of the total alkylate product. Both Fraction 3 and Fraction 4, separately or combined together, had greater than 95 vol % C10+, greater than 90 vol % C11+, and less than 1 vol % C43+ or C55+.

Example 2

Fractions 1 and 2, described above, were tested by gas chromatography for composition and octane numbers. The results are summarized below, in Table 2.

TABLE 2

| Composition, Wt % by GC | Fraction 1 | Fraction 2 |
|---|---|---|
| C5– | 3.24 | 0.01 |
| C6 | 4.30 | 0.02 |
| C7 | 6.88 | 0.02 |
| C8 | 73.96 | 9.79 |
| C9 | 11.45 | 62.36 |
| C10 | 0.02 | 21.44 |
| C11+ | 0.07 | 5.77 |
| RVP estimated from GC, psi | 2.19 | 0.40 |
| RON (GC) | 94.5 | 86.0 |
| RON | 96.4 | 88.4 |
| MON | 93.1 | 88.2 |

Fraction 1 was predominantly C8 alkylate. Fraction 2 was mostly C9 alkylate, mixed with some C10 alkylate. Both Fraction 1 and Fraction 2 were suitable for gasoline blending. Fraction 1 was an example of an especially good gasoline blend stock, with a low RVP and high RON.

Fractions 1 and 2 were both low volatility gasoline blending components. Their Reid Vapor Pressures, calculated by GC, were both less than 2.5 psi (17.2 kPa), and also less than an amount defined by the equation RVP=–0.035×(50 vol % boiling point, ° C.)+5.8, in psi.

Example 3

Fraction 3, described above, was further characterized and compared with a typical example of JET A-1 jet fuel. These results are shown in Table 3, below.

TABLE 3

| Analytical Test | Fraction 3 | JET A-1 Requirements |
|---|---|---|
| C, wt % | 85.1 | |
| H, wt % | 14.516 | |

TABLE 3-continued

| Analytical Test | Fraction 3 | JET A-1 Requirements |
|---|---|---|
| N, wt % | <1 | |
| Low level nitrogen, wppm | <1 | |
| Sulfur, wppm | <1 | Max 3000 |
| Flash Point, ° C. | 59 | Min 38 |
| Smoke Point, mm | 40 | Min 18 |
| Cloud Point, ° C. | <–63 | |
| Freeze Point, ° C. | <–63 | Max –47 |
| Density, 60° F. | 0.769 | 0.775-0.840 |
| Viscosity, –20° C., $mm^2/s$ | 8.387 | Max 8.0 |
| Net Heat of Combustion | | |
| BTU/lb | 20237 | |
| MJ/Kg | 47.1 | Min 42.8 |
| Calculated Cetane Index | 56.63 | |
| SimDist, ° C. | | |
| 10 vol % | 178 | Max 205 |
| 20 vol % | 182 | |
| 30 vol % | 187 | |
| 40 vol % | 191 | |
| 50 vol % | 199 | Report |
| 60 vol % | 208 | |
| 70 vol % | 216 | |
| 80 vol % | 231 | |
| 90 vol % | 246 | Report |
| FBP (99.5) | 274 | Max 300 |
| NMR Branching Index | 73.47 | |
| Wt % Olefins | 2.64 | |

A more detailed summary of the proton NMR analysis of Fraction 3 is summarized below in Table 4.

TABLE 4

| NMR Analysis (%) | Fraction 3 |
|---|---|
| paraffinic CH3 hydrogens | 73.32 |
| paraffinic CH2 hydrogens | 19.41 |
| paraffinic CH hydrogens | 7.06 |
| Hydrogens in saturated groups alpha to aromatic or olefinic carbon | 0.00 |
| Olefinic Hydrogens | 0.21 |
| Aromatic Hydrogens | 0.00 |
| Sum | 100.00 |
| NMR Branching Index | 73.47 |
| CH3/CH2 Hydrogen Ratio | 3.78 |
| % Aromatic Protons | 0.00 |

Fraction 3 had properties that are desired in jet fuel, and it would make an excellent jet fuel or blend stock for jet fuel production. Fraction 3 met or exceeded a number of desired JET A-1 fuel specifications, including sulfur content, flash point, smoke point, freeze point, heat of combustion, and distillation boiling points. The density was a bit low and the kinematic viscosity was a bit high. Both the viscosity and the density could be brought into the specified range for JET A-1 by addition of a second fuel blend stock rich in aromatics and/or naphthenes. The high smoke point would allow for the addition of a significant amount of a second fuel blend stock with a high aromatic content. The high heat of combustion measured on Fraction 3 was significantly higher than that typically obtained on JET A-1, and it would improve fuel efficiency if it were blended with a second fuel blend stock. The excellent low cloud point and low freeze point was related to the higher branching.

Fraction 4 was not further characterized, but its properties indicated that it was a high quality middle distillate suitable for use as a heavy diesel fuel, a blend stock for diesel fuel, or a heating oil.

Example 5

Figure 2:
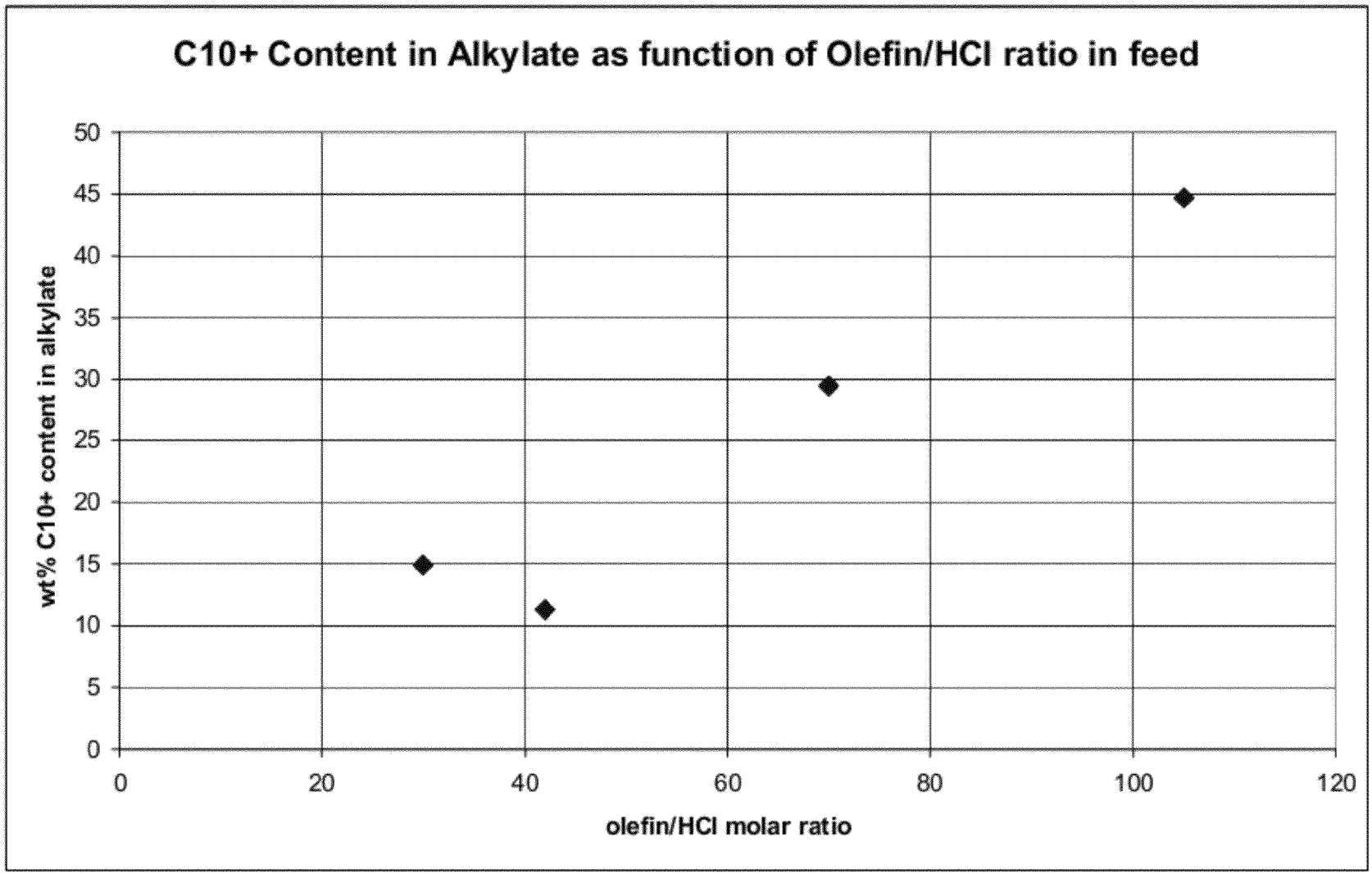
FIG. 2 is a plot of the molar ratio of olefin to HCl vs. the GC analysis of the wt % C10+ content in the alkylate.

Alkylate was prepared in a 100 ml laboratory continuously stirred (1600 RPM) reactor operating at 10° C. and 150 psig (1034 KPa). The feedstock for the alkylation was mixed C4 olefins (butene) from an FC cracker containing 40-50% olefins and the balance being isobutane and n-butane (feed flow @ 2 ml/min.), and refinery isobutane containing 80% or more of isobutane (feed flow @ 8 ml/min.). The molar ratio of isoparaffin to olefin was in the range of about 9:1. None of the feed to the alkylation reactor was oligomerized olefins. N-butylpyridinium chloroaluminate ($C_5H_5NC_4H_9Al_2Cl_7$) ionic liquid doped with hydrochloric acid was used as catalyst and added to the alkylation reactor. The ionic liquid and the hydrochloric acid were unsupported. The level of hydrochloric acid was adjusted over time from a molar ratio of olefin to HCl from 25:1 to about 105:1. The alkylate from the reactor effluent was separated from unconverted butanes by flash-distillation and the alkylate was separated from the ionic liquid by phase separation. A plot of the molar ratio of olefin to HCl vs. the GC analysis of the wt % C10+ content in the alkylate is shown in FIG. 2. A higher molar ratio of olefin to HCl in the feed to the reactor gave a higher yield of C10+ products in the alkylate product.

What is claimed is:

1. A process for producing a gasoline blending component and a middle distillate, comprising:

a. reacting a hydrocarbon stream comprising at least one olefin having from 2 to 4 carbon atoms and at least one paraffin having from 4 to 6 carbon atoms with an ionic chloroaluminate liquid catalyst and a halide containing additive, wherein at one paraffin are alkylated with at least one olefin to produce an alkylate product;

b. adjusting over time a level of said halide containing additive provided to an ionic liquid alkylation reactor to shift selectivity towards heavier products in an alkylate product; and c. recovering from the alkylate product:

i. the gasoline blending component having a RON of 91 or higher and a RVP less than 17.2 kPa; and ii. the middle distillate having greater than 95 vol % C10+ and less than 1 vol % C43+; and wherein the middle distillate is from 20 to 50 wt % of the alkylate product.

2. The process of claim 1, wherein the halide containing additive is selected from the group of hydrogen halide, metal halide, and combinations thereof.

3. The process of claim 1, wherein the halide containing additive is unsupported.

4. The process of claim 1, wherein the adjusting is a lowering of the level of the halide containing additive to increase the yield of C10+ products in the alkylate product.

5. The process of claim 1, wherein the gasoline blending component has a Reid vapor pressure less than an amount defined by the equation:

$$RVP=[-0.035\times(50\text{ vol \% boiling point, }^\circ\text{ C.})+5.8]\times 6.895\text{, in kPa.}$$

6. The process of claim 1, wherein the ionic liquid alkylation reactor uses a chloroaluminate ionic liquid catalyst comprising an alkyl substituted pyridinium chloroaluminate or an alkyl substituted imidazolium chloroaluminate of the general formulas A and B, respectively,

A

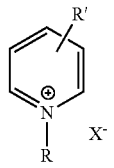

B

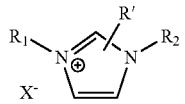

where R=H, methyl, ethyl, propyl, butyl, pentyl or hexyl group, R'=H, methyl, ethyl, propyl, butyl, pentyl or hexyl group, X is a chloroaluminate, and $R_1$ and $R_2$=H, methyl, ethyl, propyl, butyl, pentyl or hexyl group and where R, R', $R_1$ and $R_2$ may or may not be the same.

7. The process of claim 1, wherein the alkylate product has less than 5 wt % olefins prior to optional further processing.

8. The process of claim 1, wherein the yield of the alkylate product exceeds the amount of olefin supplied to the ionic liquid alkylation reactor by at least 30 wt %.

9. The process of claim 1, wherein the middle distillate has a NMR branching index greater than 60.

10. The process of claim 9, wherein the middle distillate has a CH3/CH2 hydrogen ratio greater than 2.6.

11. The process of claim 1, wherein the middle distillate has a CH3/CH2 hydrogen ratio greater than 2.6.

12. The process of claim 1, further comprising separating the gasoline blending component into two or more fractions each having a RVP less than 17.2 kPa.

* * * * *